US011678691B2

(12) United States Patent
Rabie

(10) Patent No.: US 11,678,691 B2
(45) Date of Patent: Jun. 20, 2023

(54) TOBACCO LEAF ROLLED CONE

(71) Applicant: Nader Rabie, Houston, TX (US)

(72) Inventor: Nader Rabie, Houston, TX (US)

( * ) Notice: Subject to any disclaimer, the term of this patent is extended or adjusted under 35 U.S.C. 154(b) by 463 days.

(21) Appl. No.: 16/841,909

(22) Filed: Apr. 7, 2020

(65) Prior Publication Data

US 2021/0307378 A1 Oct. 7, 2021

(51) Int. Cl.

| | |
|---|---|
| ***A24C 5/44*** | (2006.01) |
| ***A24C 3/00*** | (2006.01) |
| ***A24D 1/02*** | (2006.01) |

(52) U.S. Cl.

CPC ..... *A24C 5/44* (2013.01); *A24C 3/00* (2013.01); *A24D 1/022* (2013.01)

(58) Field of Classification Search

CPC .... A24C 5/40; A24C 1/26; A24C 5/46; A24C 5/465; A24D 1/022

See application file for complete search history.

(56) References Cited

U.S. PATENT DOCUMENTS

| | | | | |
|---|---|---|---|---|
| 7,377,281 | B2 | 5/2008 | Bachman | |
| 10,299,508 | B2 | 5/2019 | Jesperson et al. | |
| 2006/0037622 | A1* | 2/2006 | Bachmann | A24D 1/022 131/365 |
| 2020/0146335 | A1 | 5/2020 | Jackson | |
| 2020/0337365 | A1* | 10/2020 | Mendoza | A24B 9/00 |

* cited by examiner

*Primary Examiner* — Kelly M Gambetta
*Assistant Examiner* — Stephanie Lynn Moore
(74) *Attorney, Agent, or Firm* — Jeffrey Streets; Madan Law PLLC

(57) ABSTRACT

A smoking product includes a cylindrical crutch in substantial axial alignment with a hollow conical mold, and a tobacco leaf rolled cone formed around the cylindrical crutch and the hollow conical mold. A truncated minor diameter end of the hollow conical mold forms a circular rim in contact with an end of the cylindrical crutch, where the cylindrical crutch and the circular rim have substantially the same outer diameter. The hollow conical mold may remain inside the tobacco leaf rolled cone until use, but is easily removable from the tobacco leaf rolled cone without damaging the tobacco leaf rolled cone.

20 Claims, 5 Drawing Sheets

TOBACCO LEAF ROLLED CONE

BACKGROUND

The present disclosure relates to a smoking product and method of making the smoking product.

BACKGROUND OF THE RELATED ART

Making smoking products at home allows each individual to select how their smoking product is make and what materials go into the smoking product. The manner in which a smoking product is made and the materials that are include in the smoking product have a direct effect on the smoking experience. For example, quality fresh ingredients may improve flavor and consistency, while the degree of packing may control how the smoking product is consumed. However, hand rolling cigars or filling empty cylindrical casings can be challenging.

The use of a cone-shaped paper casing may reduce some of the challenges of making smoking products at home, since the wider opening of the cone is easier to fill and pack. However, the more complex conical shape of the paper casing requires additional care both to make and to protect from damage until use.

BRIEF SUMMARY

Some embodiments provide a smoking product comprising a cylindrical crutch in substantial axial alignment with a hollow conical mold. A truncated minor diameter end of the hollow conical mold forms a circular rim in contact with an end of the cylindrical crutch, where the cylindrical crutch and the circular rim have substantially the same outer diameter. The smoking product further comprises a tobacco leaf rolled cone formed around the cylindrical crutch and the hollow conical mold, wherein the hollow conical mold is removable from the tobacco leaf rolled cone without damaging the tobacco leaf rolled cone.

Some embodiments provide a method of making a smoking product. The method may comprise placing a central axis of a cylindrical crutch in substantial axial alignment with a central axis of a hollow conical mold, wherein the hollow conical mold has a minor diameter end that is truncated along a plane that is perpendicular to the central axis to form a circular rim having an outer diameter that is substantially the same as an outer diameter of the cylindrical crutch. The method may further comprise positioning the circular rim of the hollow conical mold against a circular end of the cylindrical crutch, and rolling a portion of a tobacco leaf around the cylindrical crutch and the hollow conical mold while maintaining the substantial axial alignment of the cylindrical crutch and the hollow conical mold, wherein the portion of the tobacco leaf forms a wrapper around the cylindrical crutch and the hollow conical mold, and wherein the hollow conical mold is removable from the tobacco leaf rolled cone without damaging the tobacco leaf rolled cone.

DETAILED DESCRIPTION

Figure 1A:
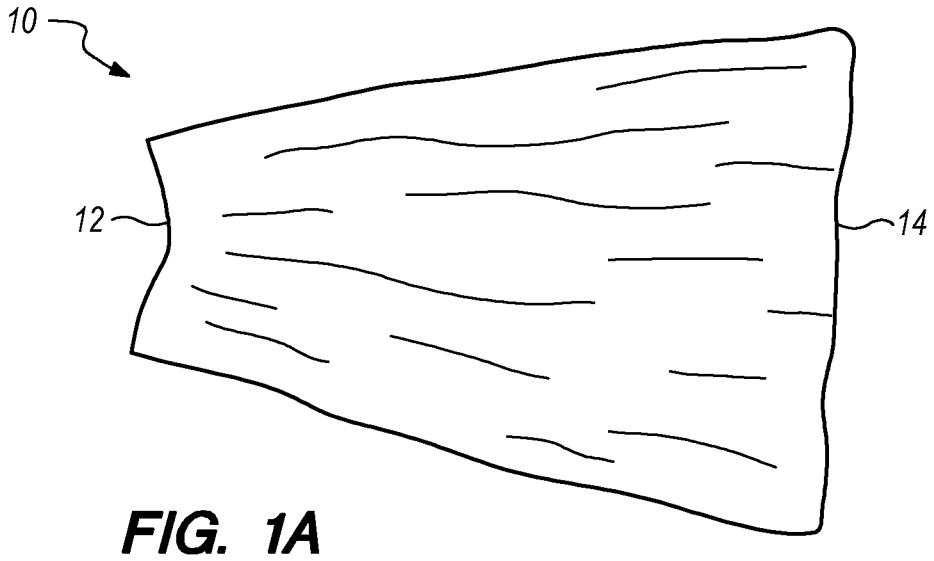
FIG. 1A is a plan view of a corn husk.

Some embodiments provide a smoking product comprising a cylindrical crutch in substantial axial alignment with a hollow conical mold. A truncated minor diameter end of the hollow conical mold forms a circular rim in contact with an end of the cylindrical crutch, where the cylindrical crutch and the circular rim have substantially the same outer diameter. The smoking product further comprises a tobacco leaf rolled cone formed around the cylindrical crutch and the hollow conical mold, wherein the hollow conical mold is removable from the tobacco leaf rolled cone without damaging the tobacco leaf rolled cone.

The term "crutch" is used to refer to a mouthpiece. A crutch will preferably form open passageways that allow a user to draw air and smoke through the smoking product and into their mouth, block bits of filler material from getting into a user's mouth, and provide a place for a user to hold the smoking product so that they don't burn their fingers or waste any of the filler material. A crutch may be a filter, but it does not have to be a filter. A cylindrical crutch may be formed by rolling a substrate into a cylindrical shape or by folding a substrate back and forth into a zig-zag or irregular pattern. A suitable substrate may be a stiff paper, similar in stiffness to an index card or business card, but is more preferably a natural material, such as a corn husk. One preferred crutch is formed by rolling a section of a corn husk to form the cylindrical crutch. A corn husk is a natural, plant-based by-product of corn production that may have generally parallel cellulosic fibers running the length of the corn husk from one end to another. The corn husk is preferably rolled so that the cellulosic fibers remain straight (i.e., parallel to an axis of the cylinder formed by rolling). Optionally, a section of the corn husk may be cut into a rectangle prior to rolling, or the corn husk may be rolled into a cylinder before cutting the cylinder perpendicular to an axis of the cylinder. The cylindrical crutch preferably has a diameter such that the cylindrical crutch will not pass through the circular rim of the hollow conical mold without deforming either the cylindrical crutch or the circular rim.

In some embodiments, the hollow conical mold may be formed with cardboard, paper, and/or hemp. In one option, the hollow conical mold may be formed from a sheet of material that is rolled into the desired conical shape. Overlapping portions of the rolled sheet may be adhered together with a glue so that the mold retains its conical shape. One non-limiting embodiment includes forming the hollow conical mold by wrapping a substrate around a rigid conical member until first and second ends of the cardboard overlap, adhering the overlapping first and second ends of the substrate together so that the substrate will retain the conical shape of the rigid conical member after removal of the rigid conical member, and cutting off a portion of the substrate to truncate the minor diameter end of the hollow conical mold and form the circular rim of the hollow conical mold. Alternatively, the hollow conical mold may be a molded pulp cone.

It should be recognized that the components used to make the smoking product may be handmade components and/or made with plant-based products or other natural products, such that the dimensions may vary slightly and irregularly. For example, the cylindrical crutch and the circular rim of the hollow conical mold may have substantially the same outer diameter so that the tobacco leaf rolled cone may have a generally smooth transition as it is wrapped around the cylindrical crutch and the hollow conical mold. However, the cylindrical crutch may an irregular or rough cylindrical surface, yet is still substantially cylindrical as a result of rolling a sheet-like substrate such as a fibrous corn husk. Accordingly, a cylindrical crutch will have a substantially circular cross section, but need not involve any post-rolling shaping or smoothing processes. Similarly, the hollow conical mold may have a surface that is substantially like a surface of a cone and is recognized as being generally conical. Furthermore, the term conical may include frustoconical shapes, but need not be exactly frustoconical or be conical at all points. For example, the tobacco leaf rolled cone may be substantially cylindrical in a portion formed around the cylindrical crutch and substantially conical in a portion formed around the hollow conical mold. Still further, the substantial axial alignment of a cylindrical crutch and a hollow conical mold may not be precise while still being generally recognized as being sufficiently axially aligned to support wrapping together with a tobacco leaf. In fact, the central axis of the cylindrical crutch and the central axis of the hollow conical mold may each be somewhat irregular, but may still be characterized as having a central axis.

Embodiments of the tobacco leaf rolled cone are formed around the cylindrical crutch and the hollow conical mold. In some embodiments, the hollow conical mold may remain inside the tobacco leaf rolled cone during shipping, storage and/or handling to support the tobacco leaf rolled cone. The hollow conical mold is easily removable from the tobacco leaf rolled cone prior to packing the tobacco leaf rolled cone with a filler, and may be disposable or recyclable. In some embodiments, the major diameter end of the hollow conical mold extends beyond the tobacco leaf rolled cone to protect the open end of the tobacco leaf rolled cone from damage. Furthermore, extending the end of the hollow conical mold beyond the tobacco leaf rolled cone enables a person to easily grab the end of the hollow conical mold and remove the hollow conical mold from the open end of tobacco leaf rolled cone. The hollow conical mold is preferably removable from the tobacco leaf rolled cone without damaging the tobacco leaf rolled cone.

In some specific non-limiting embodiments of the smoking product, the cylindrical crutch may have a diameter of between about 8 millimeters and about 10 millimeters, and a length between about 18 millimeters and about 22 millimeters. In one preferred non-limiting embodiment of the smoking product, the cylindrical crutch may have a diameter of about 9 millimeters and a length of about 20 millimeters.

In some specific non-limiting embodiments of the smoking product, the tobacco leaf rolled cone may have an axial dimension (i.e., total length) of between about 90 millimeters and about 100 millimeters, a minor diameter of between about 8 millimeters and about 10 millimeters, and a major diameter of between about 16 millimeters and about 20 millimeters. In one preferred non-limiting embodiments of the smoking product, the tobacco leaf rolled cone may have an axial dimension of about 95 millimeters, a minor diameter of about 9 millimeters, and a major diameter of about 18 millimeters.

Some embodiments provide a method of making a smoking product. The method may comprise placing a central axis of a cylindrical crutch in substantial axial alignment with a central axis of a hollow conical mold, wherein the hollow conical mold has a minor diameter end that is truncated along a plane that is perpendicular to the central axis to form a circular rim having an outer diameter that is substantially the same as an outer diameter of the cylindrical crutch. The method may further comprise positioning the circular rim of the hollow conical mold against a circular end of the cylindrical crutch, and rolling a portion of a tobacco leaf around the cylindrical crutch and the hollow conical mold while maintaining the substantial axial alignment of the cylindrical crutch and the hollow conical mold, wherein the portion of the tobacco leaf forms a wrapper around the cylindrical crutch and the hollow conical mold, and wherein the hollow conical mold is removable from the tobacco leaf rolled cone without damaging the tobacco leaf rolled cone.

The portion of the tobacco leaf may be any suitable portion of the tobacco leaf, such as an entire tobacco leaf or a half tobacco leaf without the central vein. Furthermore, the tobacco leaf is preferably a natural tobacco leaf, but may also be treated or processed in any manner without departing from the disclosed embodiments. In some embodiments, the portion of the tobacco leaf may be rolled in an overlapping pattern starting adjacent a first end of the cylindrical crutch and proceeding over the cylindrical crutch and the hollow conical mold. Overlapping portions of the tobacco leaf may be adhered together to prevent unrolling of the tobacco leaf rolled cone. For example, cigar glue may be applied overlapping portions at any point of overlap, but preferably near the open end of the tobacco leaf rolled cone. Furthermore, cigar glue or other adhesive may be applied between the cylindrical crutch and the portion of the tobacco leaf that contacts the cylindrical crutch.

Embodiments of the method of making the smoking product may include any one or more aspect or feature of the smoking product described herein. Similarly, embodiments of the smoking product may include any one or more aspect or feature described in the contest of the method of making the smoking product.

FIG. 1A is a plan view of a corn husk 10. A corn husk is a by-product of corn production and is removed from an ear of corn. Each corn husk has thick fibers that run along the length of the husk from top to bottom (from a left end 12 to a right end 14 as shown in FIG. 1A).

Figure 1B:
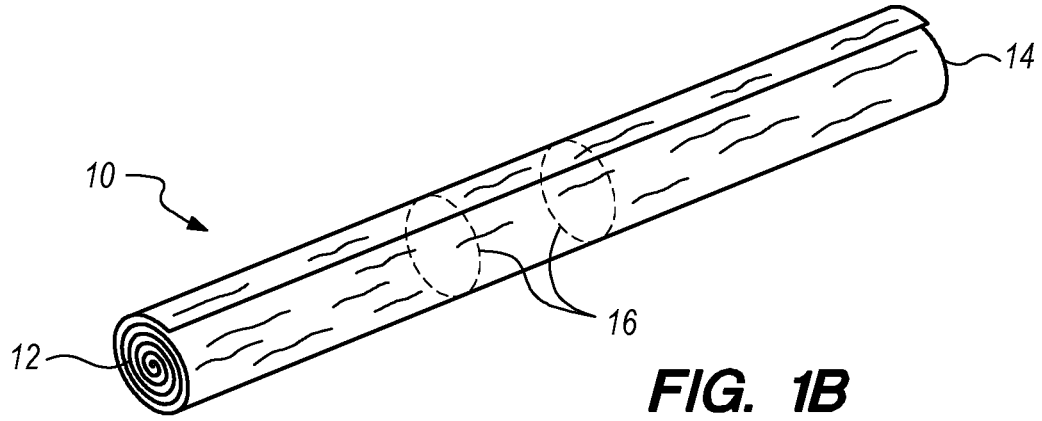
FIG. 1B is a perspective view of a corn husk after rolling.

FIG. 1B is a perspective view of the corn husk 10 after rolling into a cylindrical shape. As shown, the corn husk has been rolled up from one edge with the thick fibers of the corn husk running from the left end 12 to the right end 14. This orientation of the thick fibers leaves open passageways for drawing air and smoke. If the diameter of the cylindrical shape is greater than desired, then an edge of the corn husk may be trimmed until the desired diameter is obtained. A pair of dashed lines 16 are shown to illustrate how the rolled corn husk 10 may be cut cross-wise (i.e., perpendicular to an axis of the cylindrical shape) to form an individual cylindrical crutch. It is possible to cut several crutches from a single corn husk.

Figure 1C:
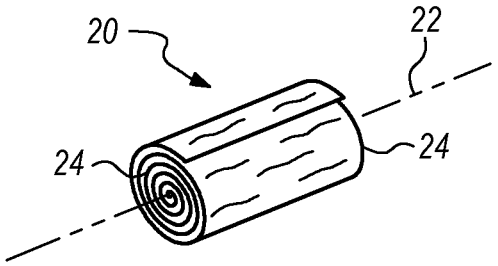
FIG. 1C is a perspective view of a cylindrical crutch formed by cutting a section from the rolled corn husk.

FIG. 1C is a perspective view of a cylindrical crutch 20 that is formed from the rolled corn husk 10 after making the two cuts indicated by the dashed lines 16 in FIG. 1B. The cylindrical crutch 20 is substantially cylindrical and is illustrated having a substantially central axis 22 and two ends 24 that are substantially flat and perpendicular to the axis 22. While the perimeter surface of the cylindrical crutch 20 may be somewhat irregular due to natural variation in the corn husk and the ends 24 may be somewhat irregular due to cutting the corn husk fibers. Still, the cylindrical crutch 20 is substantially cylindrical even when made with a corn husk as shown.

Figure 1D:
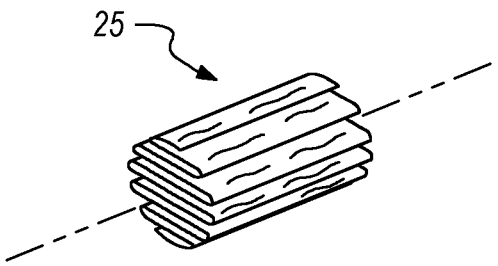
FIG. 1D is a perspective view of a cylindrical crutch formed by folding the corn husk in a back-and-forth pattern.

FIG. 1D is a perspective view of a cylindrical crutch 25 formed by folding the corn husk in a back-and-forth pattern. Each folded row may have a different width before the next fold, such that the collection of folded edges define a cylindrical shape.

Figure 2A:
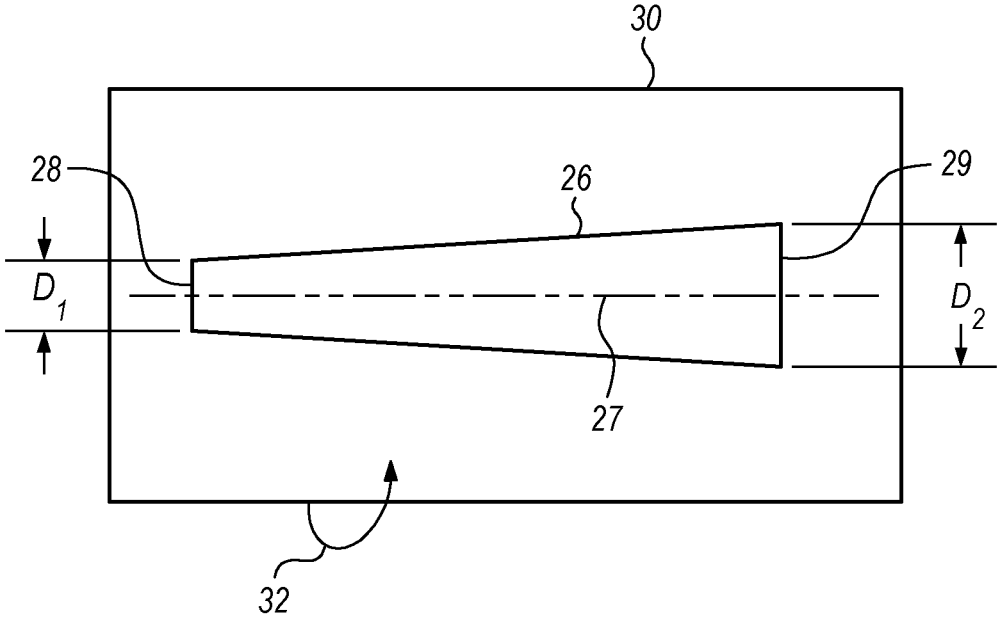
FIG. 2A is a plan view of a frustoconical member set on a substrate that will form a hollow conical mold.

FIG. 2A is a plan view of a rigid frustoconical member 26 set on a sheet-like substrate 30 that will form a hollow conical mold. For example, the sheet-like substrate may be cardboard, paper and/or hemp. A hollow conical mold (shown later in FIG. 2C) may be created by wrapping the substrate 30 around the rigid frustoconical member 26. As illustrated, one edge of the substrate 30 may be wrapped in the direction of the arrow 32 against the rigid frustoconical member 26 and then further rolled around the rigid frustoconical member 26 until the opposing edges (top and bottom edges as shown in FIG. 2A) of the substrate 30 are overlapping. An adhesive may be applied between the overlapping edges so that the substrate 30 will retain a conical shape corresponding to the shape of the rigid frustoconical member 26 after removal of the rigid frustoconical member 26. Note that the rigid frustoconical member 26 has a central axis 27, a minor diameter end 28 having a diameter $D_1$ and a major diameter end 29 having a diameter $D_2$ greater than the diameter $D_1$.

Figure 2B:
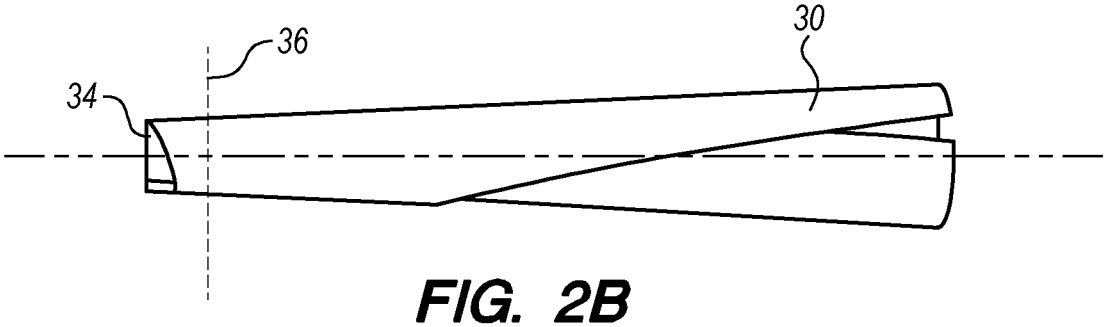
FIG. 2B is a side view of the hollow conical mold formed from the substrate.

FIG. 2B is a side view of the substrate 30 after removal of the rigid frustoconical member 26. The substrate 30 now has a conical shape, but the small end 34 may be not be flat or have the same outer diameter as the cylindrical crutch 20 shown in FIG. 1C. So, the small end 34 of the conically shaped substrate 30 may be trimmed along line 36 to form a circular rim having the desired diameter.

Figure 2C:
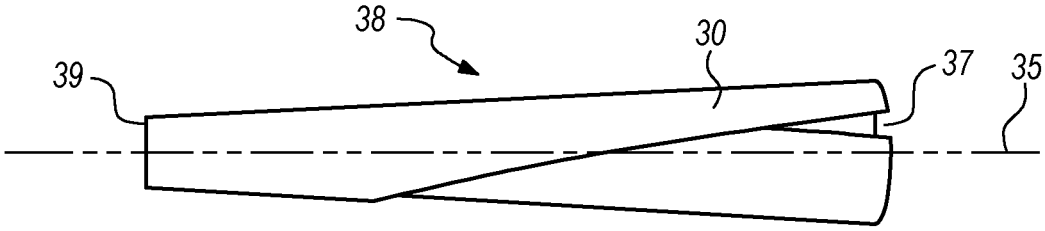
FIG. 2C is a side view of the hollow conical mold with a truncated minor diameter end.

FIG. 2C is a side view of a hollow conical mold 38 with a truncated minor diameter end 39 that forms a circular rim. The hollow conical mold 38 may generally define a central axis 35. A gap 37 is show at the major diameter end of the hollow conical mold 38 for illustration only, and it should be recognized that the hollow conical mold 38 may be effective with or without such a gap 37.

Figure 3A:
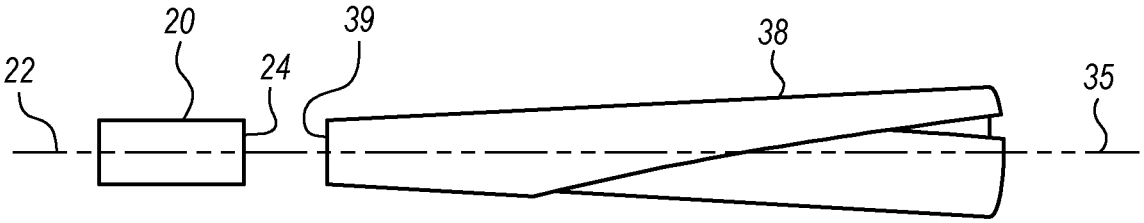
FIG. 3A is a side view of the cylindrical crutch in substantial axial alignment with the hollow conical mold with a truncated minor diameter end.

FIG. 3A is a side view of the cylindrical crutch 20 in substantial axial alignment with the hollow conical mold 38. Note that the central axis of the cylindrical crutch 20 and the central axis of the hollow conical mold 38 lie along a common axis and are therefore axially aligned. Furthermore, an end 24 of the cylindrical crutch 20 is adjacent the truncated minor diameter end 39 of the hollow cylindrical mold 38. The outer diameter of the cylindrical crutch 20 and the truncated minor diameter end 39 are substantially the same within a range a variation in the natural materials and consistency in preparation of the crutch and the mold.

Figure 3B:
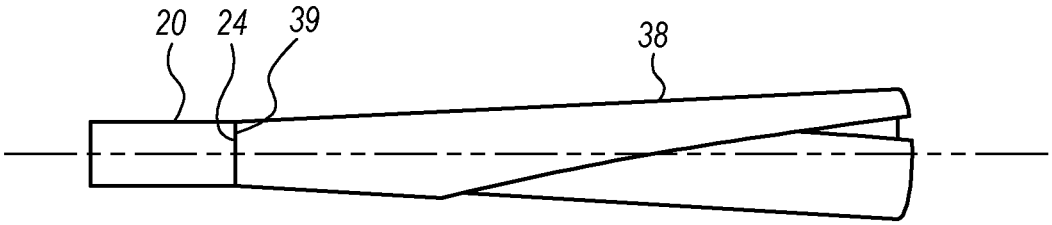
FIG. 3B is a side view of the cylindrical crutch in substantial axial alignment with the hollow conical mold and in contact with the truncated minor diameter end of the hollow conical mold.

FIG. 3B is a side view of the cylindrical crutch 20 in substantial axial alignment with the hollow conical mold 38 and with the circular end 24 of the cylindrical crutch 20 in contact with the truncated minor diameter end 39 of the hollow conical mold 38. The cylindrical crutch 20 preferably will not pass through the open, circular rim defined by the truncated minor diameter end 39 of the hollow conical mold 38 without deforming either the cylindrical crutch or the circular rim. The relative positioning of the cylindrical crutch 20 and the hollow conical mold 38 shown in FIG. 3B is maintained during the wrapping of a tobacco leaf around the crutch and mold.

Figure 4A:
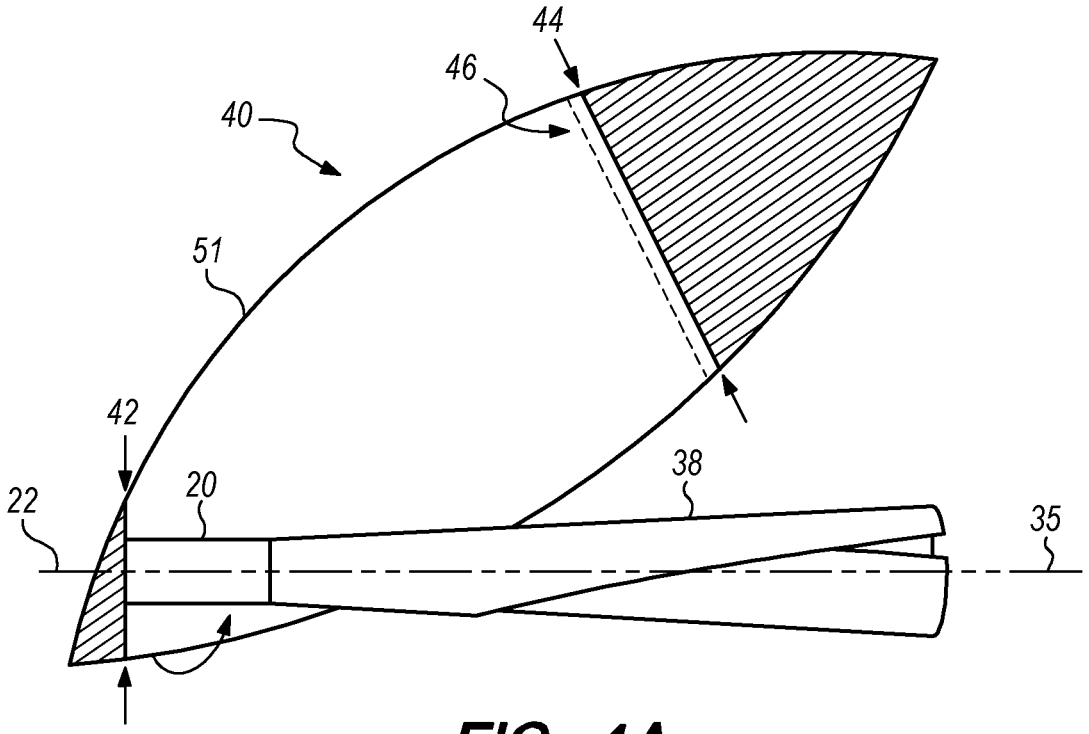
FIG. 4A is a plan view of a portion of a tobacco leaf laid out flat in a position to be rolled around the cylindrical crutch and hollow conical mold.

FIG. 4A is a plan view of a portion of a tobacco leaf 40 laid out flat in a position to be rolled around the cylindrical crutch 20 and the hollow conical mold 38 while they are held together and maintained in substantial axial alignment as shown in FIG. 3B. In some embodiments, the tobacco leaf 40 may be cut prior to rolling. In the present illustration, the tobacco leaf 40 has been cut along a first line 42 and a second line 44 which are made at distances and angles determined to form a complete tobacco leaf rolled cone for the given dimensions of the crutch and mold. Optionally, one or more of the lines 42, 44 may be a straight line and/or a curved line. Such distances and angles may be determined empirically by wrapping an uncut tobacco leaf or similar material around the crutch and mold, then marking the tobacco leaf or other material where it should be cut. The marked tobacco leaf or other material may then form a template for cutting subsequent tobacco leaves.

In the non-limiting embodiment shown in FIG. 4A, the tobacco leaf extends at an angle to the common central axis 22, 35 of the cylindrical crutch 20 and the hollow conical mold 38 so that the tobacco leaf will be rolled around the crutch and mold in an overlapping pattern starting adjacent a first end of the cylindrical crutch and proceeding over the cylindrical crutch 20 and the hollow conical mold 38. The overlapping pattern may leave one exposed edge 51 of tobacco leaf that follows a spiral pattern from one end of the tobacco leaf rolled cone to another. Overlapping portions of the tobacco leaf may be adhered together to prevent unrolling of the tobacco leaf rolled cone. For example, a cigar glue may be applied to the top surface of the tobacco leaf in a region 46 so that it is secured to another portion of the tobacco leaf that the region 46 will overlap. Accordingly, the portion of the tobacco leaf 40 forms a wrapper around the cylindrical crutch 20 and the hollow conical mold 38. However, it should be appreciated that the hollow conical mold 38 is removable from the tobacco leaf rolled cone without damaging the tobacco leaf rolled cone since the mold is not attached to either the crutch 20 or to the tobacco leaf at any point. The hollow conical mold 38 may be frictionally held within the tobacco leaf rolled cone due to the rough surfaces of the mold and leaf and the amount to which the tobacco leaf 40 is stretched tight as it is wrapped around the hollow conical mold 38. This friction is easily overcome by grasping and gently pulling the end of the hollow conical mold 38 that extends beyond the tobacco leaf rolled cone.

Figure 4B:
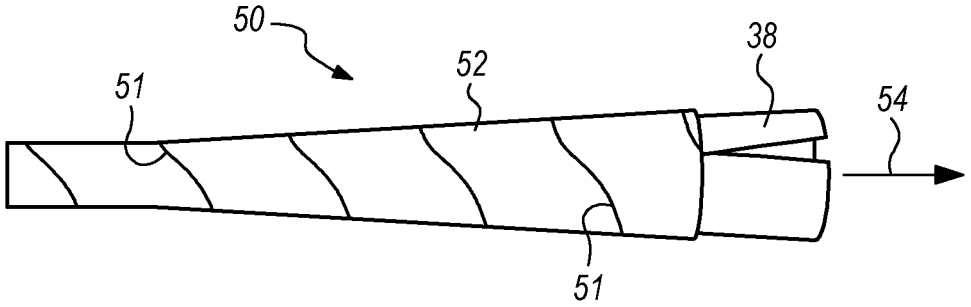
FIG. 4B is a side view of a smoking product including a tobacco leaf rolled cone formed about a cylindrical crutch and a removable hollow conical mold.

FIG. 4B is a side view of a finished smoking product 50 including a tobacco leaf rolled cone 52 formed about the cylindrical crutch 20 (not visible in this side view) and the removable hollow conical mold 38. The tobacco leaf rolled cone 52 may have a spiral appearance provided by the exposed edge of the tobacco leaf. However, the hollow conical mold 38 preferably remains inside the tobacco leaf rolled cone 52 during shipping, storage and/or handling of the smoking product 50 in order to support the shape and condition of the tobacco leaf rolled cone 52.

Figure 5A:
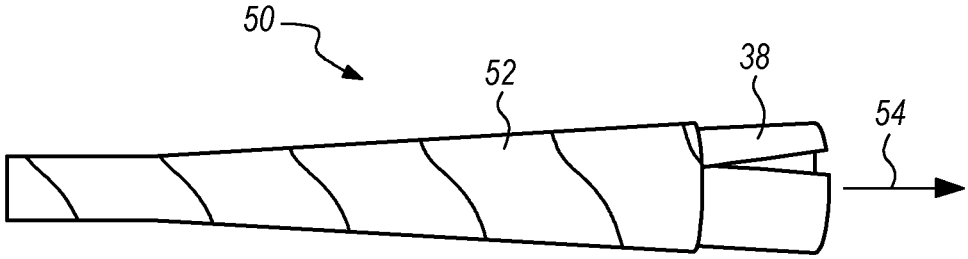
FIG. 5A is a side view of the smoking product illustrating that the hollow conical mold can be easily removed from an opening in a major diameter end of the tobacco leaf rolled cone.

FIG. 5A is a side view of the smoking product 50 illustrating that the hollow conical mold 38 can be easily removed from the opening in the major diameter end of the tobacco leaf rolled cone 52. Note that the hollow conical mold 38 extends beyond the major diameter end of the tobacco leaf rolled cone 52 by a sufficient distance to be grabbed between a two fingers of a user's hand and pulled out in a right hand direction as shown by arrow 54 in FIG. 4B. The hollow conical mold 38 is not a consumable component of the smoking product 50 and should be removed from the tobacco leaf rolled cone prior to packing with a filler.

Figure 5B:
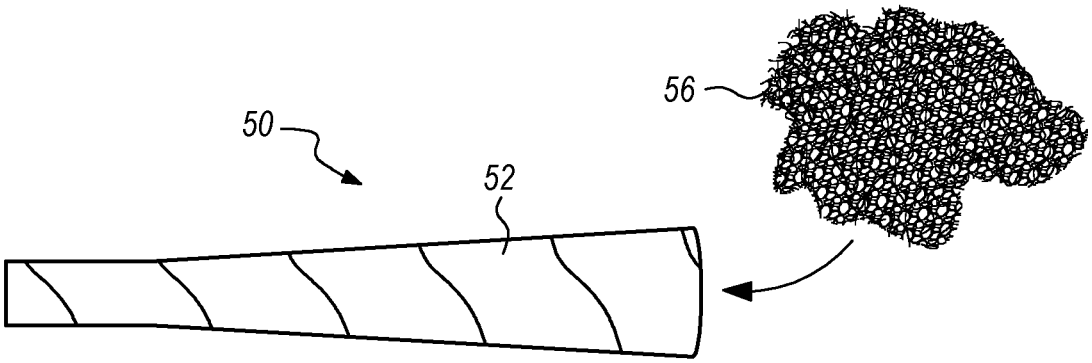
FIG. 5B is a side view of the smoking product illustrating that a filler may be packed into the tobacco leaf rolled cone through the opening in the major diameter end.

FIG. 5B is a side view of the tobacco leaf rolled cone 52 ready to be packed with a consumable filler material (or simply "filler") 56, such as tobacco that has been crushed, ground or shredded. The tobacco leaf rolled cone 52 is typically vertically oriented during the packing process, such that the open major diameter end is upwardly directed and the filler material 56 can be dropped therein without falling out. A packing stick may be used to achieve a desired compaction of the filler material 56 inside the wrapper 52 and against the cylindrical crutch 20 (not shown).

Figure 5C:
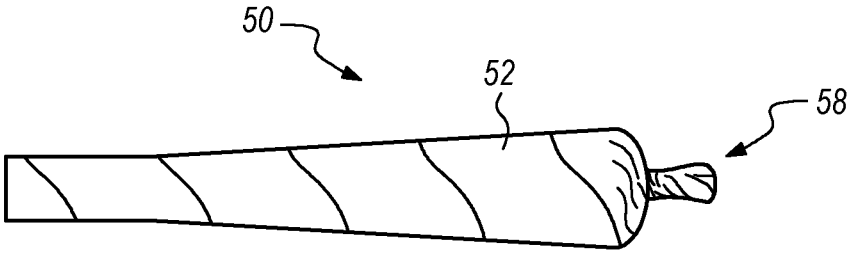
FIG. 5C is a side view of the smoking product with the major diameter end twisted closed to contain the filler inside the tobacco leaf rolled cone.

FIG. 5C is a side view of the tobacco leaf rolled cone 52 with the major diameter end twisted closed (see twist at point 58) to contain the filler 56 inside the space defined by the tobacco leaf rolled cone 52 and the cylindrical crutch 20. The smoking product is then ready to light and smoke.

The terminology used herein describes particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A smoking product, comprising:

a cylindrical crutch in substantial axial alignment with a hollow conical mold, wherein a truncated minor diameter end of the hollow conical mold forms a circular rim in contact with an end of the cylindrical crutch, and wherein the cylindrical crutch and the circular rim have substantially the same outer diameter; and a tobacco leaf rolled cone formed around the cylindrical crutch and the hollow conical mold, wherein the hollow conical mold is removable from the tobacco leaf rolled cone without damaging the tobacco leaf rolled cone.

2. The smoking product of claim 1, wherein the cylindrical crutch is formed by rolling a corn husk into a cylindrical shape.

3. The smoking product of claim 2, wherein the cylindrical crutch has a diameter of about 9 millimeters and a length of about 20 millimeters.

4. The smoking product of claim 1, wherein the tobacco leaf rolled cone has an axial dimension of about 95 millimeters, a minor diameter of about 9 millimeters, and a major diameter of about 18 millimeters.

5. The smoking product of claim 1, wherein the hollow conical mold is formed with cardboard, paper, and/or hemp.

6. The smoking product of claim 1, wherein the hollow conical mold is easily removable from the tobacco leaf rolled cone prior to packing with a filler.

7. The smoking product of claim 1, wherein the hollow conical mold remains inside the tobacco leaf rolled cone during shipping, storage and/or handling to support the tobacco leaf rolled cone, and wherein the hollow conical mold is easily removable from the tobacco leaf rolled cone prior to packing the tobacco leaf rolled cone with a filler without damaging the tobacco leaf rolled cone.

8. The smoking product of claim 7, wherein a major diameter end of the hollow conical mold extends beyond the tobacco leaf rolled cone.

9. The smoking product of claim 1, wherein portions of the tobacco leaf rolled cone are secured together with cigar glue.

10. A method of making a smoking product, comprising:

placing a central axis of a cylindrical crutch in substantial axial alignment with a central axis of a hollow conical mold, wherein the hollow conical mold has a minor diameter end that is truncated along a plane that is perpendicular to the central axis to form a circular rim having an outer diameter that is substantially the same as an outer diameter of the cylindrical crutch;

positioning the circular rim of the hollow conical mold against a circular end of the cylindrical crutch; and rolling a portion of a tobacco leaf around the cylindrical crutch and the hollow conical mold while maintaining the substantial axial alignment of the cylindrical crutch and the hollow conical mold, wherein the portion of the tobacco leaf forms a wrapper around the cylindrical crutch and the hollow conical mold, and wherein the hollow conical mold is removable from the tobacco leaf rolled cone without damaging the tobacco leaf rolled cone.

11. The method of claim 10, wherein the tobacco leaf is rolled in an overlapping pattern starting adjacent a first end of the cylindrical crutch and proceeding over the cylindrical crutch and the hollow conical mold, and wherein overlapping portions of the tobacco leaf are adhered together to prevent unrolling of the tobacco leaf rolled cone.

12. The method of claim 10, wherein the cylindrical crutch will not pass through the circular rim of the hollow conical mold without deforming either the cylindrical crutch or the circular rim.

13. The method of claim 10, further comprising:

rolling a section of a corn husk to form the cylindrical crutch.

14. The method of claim 13, wherein the section of the corn husk is cut into a rectangle prior to rolling.

15. The method of claim 13, wherein the corn husk is rolled into a cylinder before cutting the cylinder perpendicular to an axis of the cylinder.

16. The method of claim 10, wherein the hollow conical mold is formed with cardboard, paper and/or hemp.

17. The method of claim 10, further comprising:

forming the hollow conical mold by wrapping a substrate around a rigid conical member until first and second ends of the substrate overlap;

adhering the overlapping first and second ends of the substrate together so that the substrate will retain the conical shape of the rigid conical member after removal of the rigid conical member; and cutting off a portion of the substrate to form the circular rim of the hollow conical mold.

18. The method of claim 10, wherein a major diameter end of the hollow conical mold extends beyond the tobacco leaf rolled cone.

19. The method of claim 10, wherein the hollow conical mold remains inside the tobacco leaf rolled cone following rolling to support the tobacco leaf rolled cone during shipping, storage and/or handling, and wherein the hollow conical mold is easily removable from the tobacco leaf rolled cone prior to packing the tobacco leaf rolled cone with a filler without damaging the tobacco leaf rolled cone.

20. The method of claim 10, further comprising:

applying cigar glue between the cylindrical crutch and the portion of the tobacco leaf that contacts the cylindrical crutch.

* * * * *